US010837739B2

(12) United States Patent
Ramirez

(10) Patent No.: US 10,837,739 B2
(45) Date of Patent: Nov. 17, 2020

(54) PICATINNY INTERFACE

(71) Applicant: Michael Jesus Ramirez, Spring Lake, NC (US)

(72) Inventor: Michael Jesus Ramirez, Spring Lake, NC (US)

( * ) Notice: Subject to any disclaimer, the term of this patent is extended or adjusted under 35 U.S.C. 154(b) by 0 days.

(21) Appl. No.: 16/283,740

(22) Filed: Feb. 23, 2019

(65) Prior Publication Data

US 2020/0271422 A1 Aug. 27, 2020

(51) Int. Cl.
*F41G 11/00* (2006.01)
*F41C 27/00* (2006.01)

(52) U.S. Cl.
CPC ..... *F41G 11/003* (2013.01); *F41C 27/00* (2013.01)

(58) Field of Classification Search
CPC ..... F41C 33/00; F41G 11/003; F41G 11/004
USPC ..... 42/90
See application file for complete search history.

(56) References Cited

U.S. PATENT DOCUMENTS 6,637,144 B2 * 10/2003 Nelson ..... F41G 1/35 42/120
9,618,302 B2 * 4/2017 Kintzing ..... F41G 11/003
10,323,939 B1 * 6/2019 Vinande ..... G01C 9/02
2002/0162267 A1 * 11/2002 Nelson ..... F41G 1/35 42/120
2008/0168696 A1 * 7/2008 Orne ..... F41A 35/00 42/90
2009/0000174 A1 * 1/2009 Davis ..... F41G 11/003 42/90
2015/0041538 A1 * 2/2015 Teetzel ..... F41G 1/36 235/404

OTHER PUBLICATIONS

"Universal Picatinny Phone Mount From Targetvision" http://www.thefirearmblog.com/blog/2015/03/04/universal-picatinny-phone-mount/ (Year: 2015).*

* cited by examiner

*Primary Examiner* — Samir Abdosh

(57) ABSTRACT

A picatinny interface is configured to removably attach to a picatinny rail on a firearm while simultaneously statically supporting an electronic device which the user can easily view while operating the firearm. The picatinny interface includes a locking clamp, locking bolt, springs, and a universal picatinny rail mount which enables the picatinny interface to removably attach to the firearm's picatinny rail. A cam lever having an engage position and disengage position is implemented to enable the user to removably engage the picatinny interface with the picatinny rail. A safety lock is used with the cam lever to prevent the cam lever from inadvertently disengaging during firearm use. The picatinny interface includes a spring-loaded x-grip in which the electronic device is placed and supported. When assembled, the user can easily view an application, such as a ballistic calculator, on the electronic device while operating the firearm.

13 Claims, 5 Drawing Sheets

PICATINNY INTERFACE

BACKGROUND

Firearms like rifles can utilize various sensory equipment to enhance a shooter's accuracy when firing their weapon. Smartphones and other portable computing devices can be configured with sensors that the shooter can conveniently utilize while operating the firearm.

SUMMARY

A picatinny interface is configured to removably attach to a picatinny rail on a firearm while supporting an electronic device for utilization by a user. The picatinny interface affixes to the firearm via a universal picatinny rail mount that removably engages with a locking clamp attached with the picatinny rail on the firearm. A head of a locking bolt attached to the locking clamp fits inside a corresponding opening on a cam lever and is secured in place by a safety lock and a locking spring. The cam lever moves in two positions, an engage position and a disengage position, by which the locking clamp securely engages and disengages with the universal picatinny rail mount.

In the engage position a pair of springs engage with corresponding holes on the universal picatinny rail mount and the locking bolt engages with a corresponding hole on the universal picatinny rail mount. The springs push against the locking clamp for additional stabilization of the device against the picatinny rail. Disengaging the universal picatinny rail mount from the locking clamp on the firearm is done by removing the safety lock and the locking spring and then lifting the cam lever to the disengage position. In the engage position the cam lever is oriented parallel to and rests against the locking clamp. In the disengage position the cam lever is oriented upright to the to the locking clamp, such as perpendicular.

The universal picatinny rail mount is attached to two steel rods which extend to a coupling housing that attaches to a receiving portion that receives and supports an electronic device, such as a smartphone, tablet computer, and the like. The receiving portion is comprised of a backing platform and a series of grips on movable arms that extend from the backing platform and form an x-grip configuration. The backing platform may be a flat surface to provide support to an electronic device that is positioned inside the grips. The movable arms are spring-loaded which enable the movable arms to move toward an x-axis of the x-grip to enable insertion of the electronic device, and then springs back toward the y-axis position to capture and squeeze the electronic device between the grips.

Utilization of the picatinny interface enables a user to operate various sensory devices and applications exposed on the electronic device, like a smartphone, while operating the firearm. Since the electronic device is statically affixed to the picatinny interface, movement of the firearm translates to corresponding movement of the electronic device to enable the user to continue viewing the electronic device's running applications. For example, a ballistic calculator application operating on the user's smartphone may be attached to the picatinny interface so the user can observe the application's graphical user interface on the smartphone while operating the firearm.

DETAILED DESCRIPTION

The aspects, features and advantages of the present disclosure will be appreciated when considered with reference to the following description of preferred embodiments and accompanying figures. The following description does not limit the disclosure; rather, the scope is defined by the appended claims and equivalents. While certain processes in accordance with example embodiments are shown in the figures as occurring in a linear fashion, this is not a requirement unless expressly stated herein. Different processes may be performed in a different order or concurrently.

Figure 1:
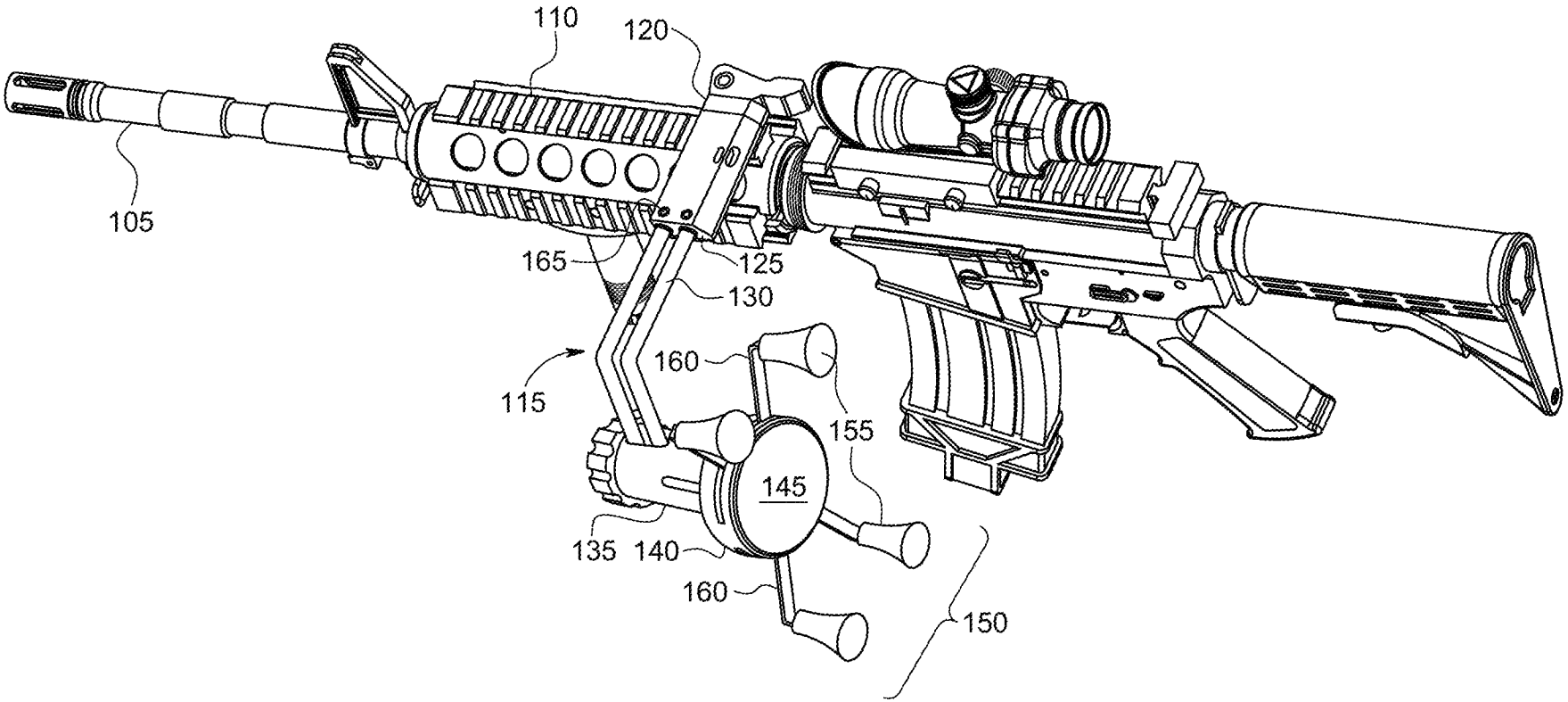
FIG. 1 shows an illustrative diagram of a picatinny interface attached to a firearm.

FIG. 1 shows an illustrative firearm 105 (e.g., rifle) having a picatinny rail 110 to which a picatinny interface 115 is attached. While a firearm is described herein as the primary object to which the picatinny interface is attached and utilized with, other primary objects are also possible. For example, scopes such as monoscopes, telescopes, and spotting scopes which are outfitted with a picatinny rail.

The various components of the picatinny interface may be comprised of a metallic material such as steel, aluminum, or copper, or can alternatively be comprised of a plastic or other polymeric material that has sufficient strength for the purposes and uses described herein. The picatinny interface is configured for holding an electronic device, such as while the firearm is in use. The electronic device can be, for example, a smartphone, tablet computer, or the like that is capable of fitting inside the receiving portion 140 of the picatinny interface, as discussed in greater detail below. The electronic device can correspondingly move with movement of the firearm while the picatinny interface is statically attached to the picatinny rail. This corresponding movement enables the user to maintain a direct line of sight with the electronic device while the user operates and moves the firearm.

Figure 2:
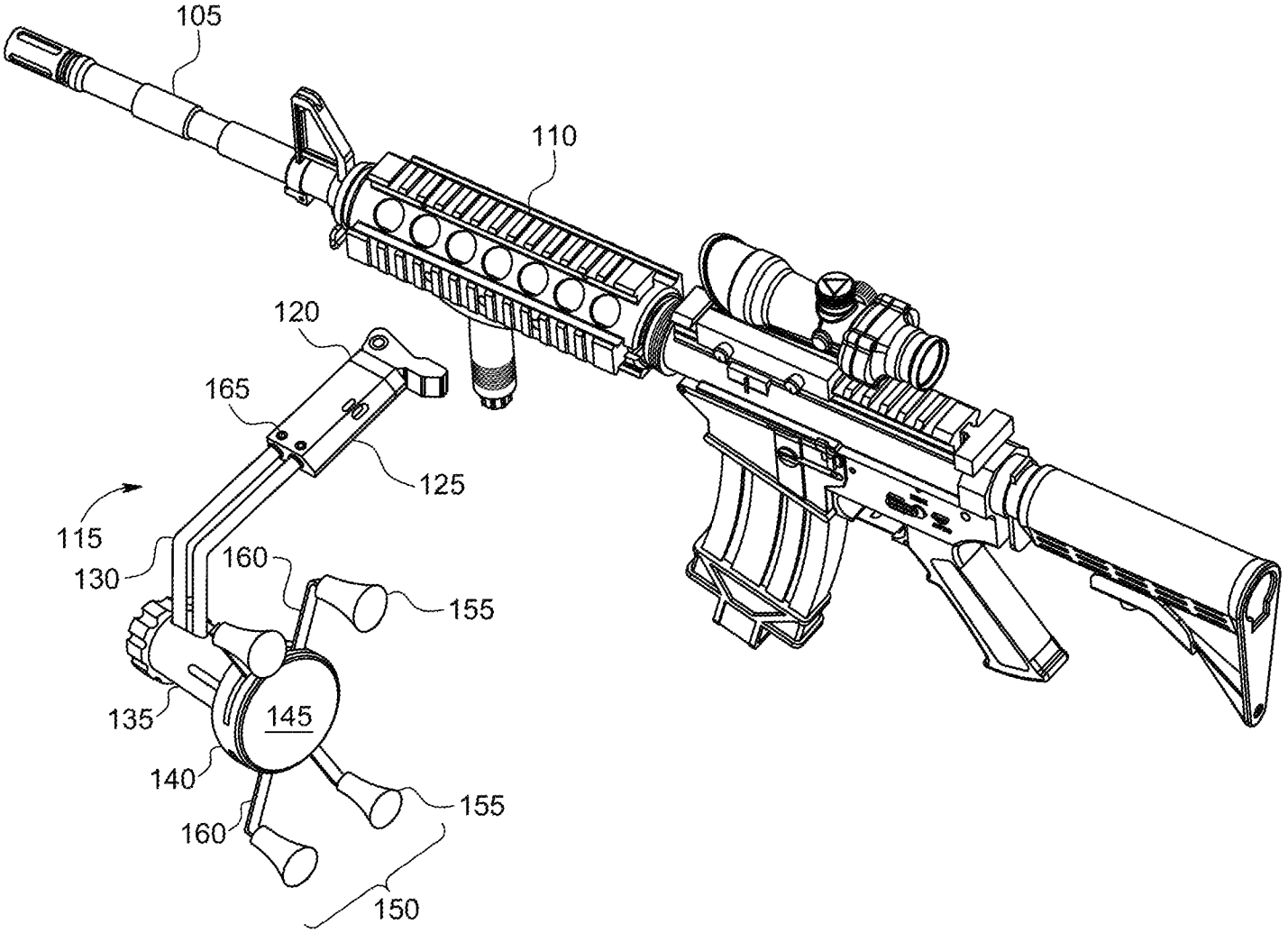
FIG. 2 shows an illustrative diagram of the picatinny interface adjacent to the firearm.
Figure 3:
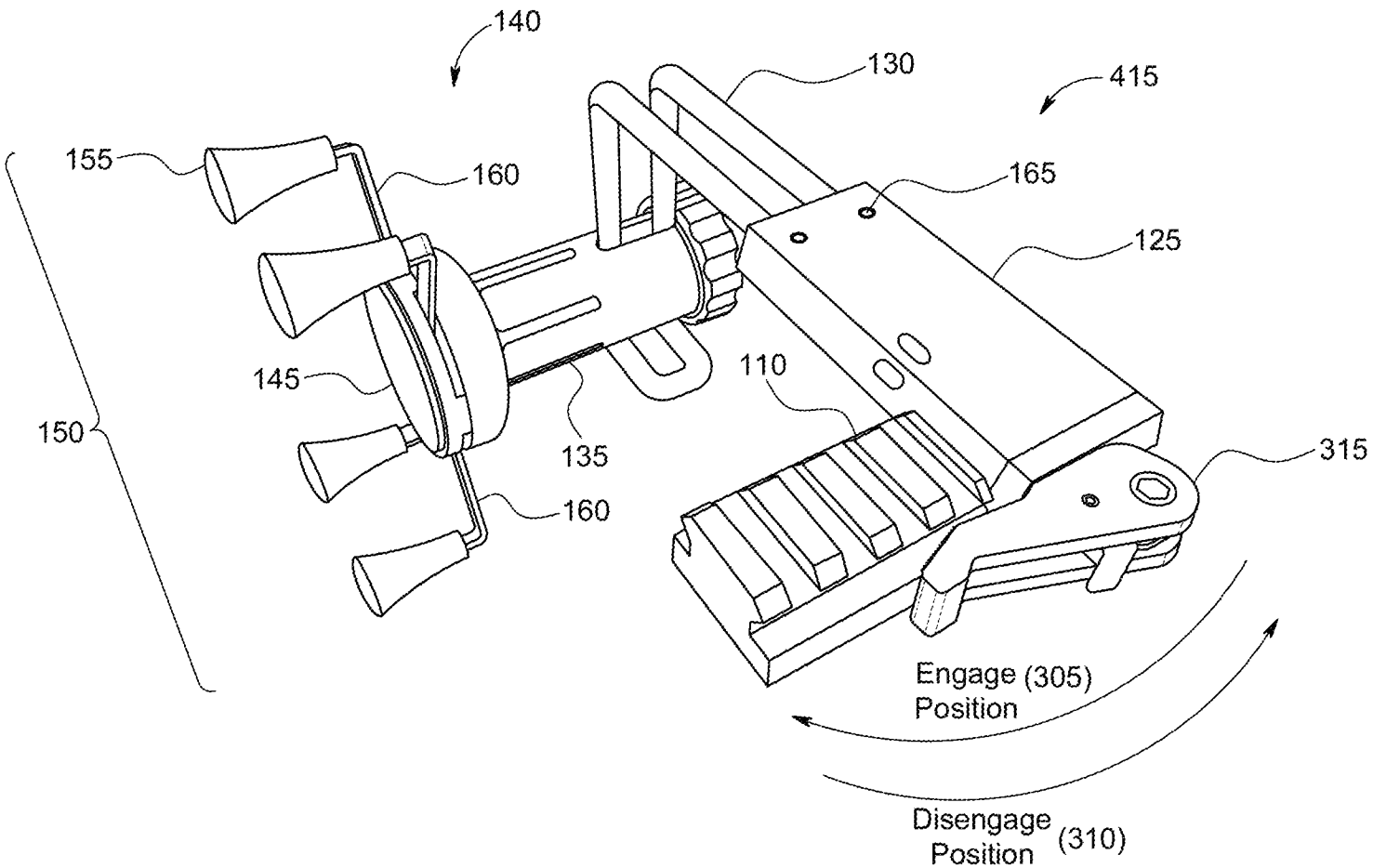
FIG. 3 shows an illustrative diagram of the picatinny interface with a cam lever having an engage and disengage position.
Figure 5:
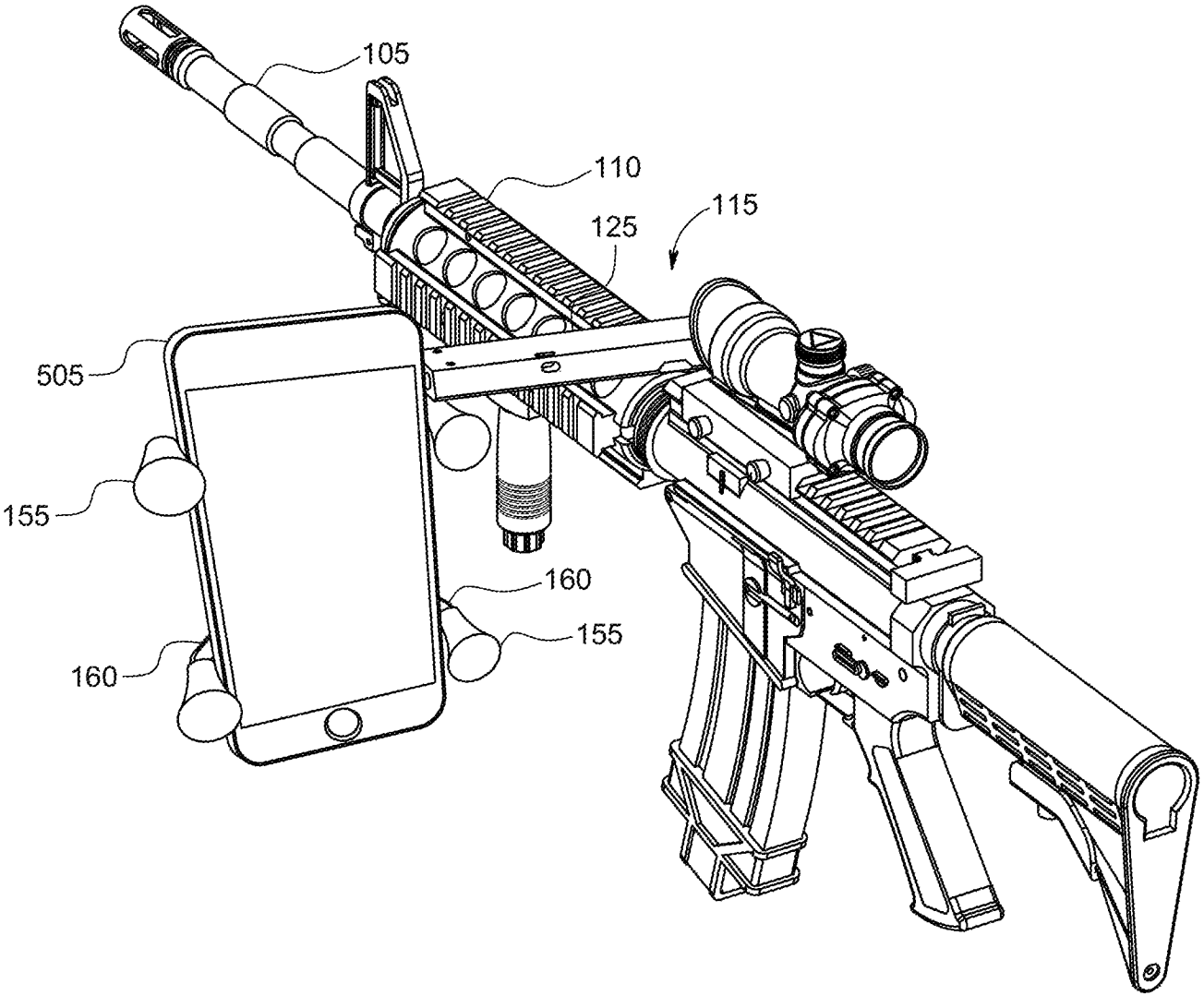
FIG. 5 shows an illustrative diagram of the picatinny interface attached to the firearm and supporting an electronic device within an x-grip.

FIGS. 1 and 2 show different views of the picatinny interface 115 in an attached state and a detached state to the firearm, respectively. FIG. 3 illustratively shows the picatinny interface 115 without the firearm. Multiple components are utilized in the picatinny interface which collectively facilitate and enable the picatinny interface's functionality and usage. The picatinny interface includes a locking clamp 120, universal picatinny rail mount 125, steel rods 130, coupling housing 135, and a receiving portion 140. The receiving portion is comprised of a backing platform 145, an x-grip 150 which has multiple grips 155 and movable arms 160 which hold and provide support for the electronic device when positioned therebetween (FIG. 5).

Figure 4:
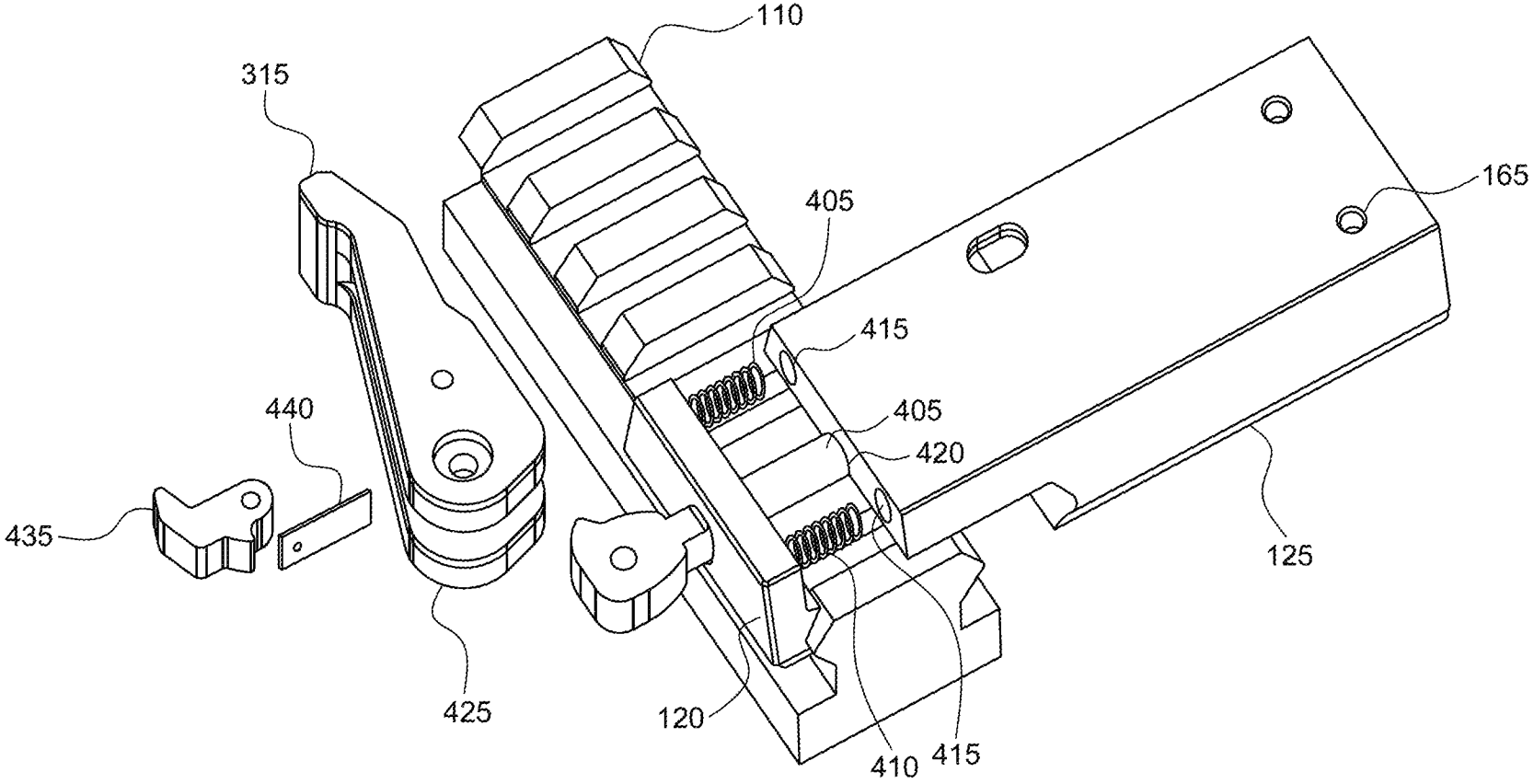
FIG. 4 shows an illustrative diagram of individual components for the picatinny interface.

FIG. 4 illustratively shows a diagram with components for the universal picatinny rail mount that enable the picatinny interface 115 to removably attach to the picatinny rail 110 on the firearm 105. A locking bolt 405 extends through a hole in the locking clamp 120. Springs 410 are affixed to the locking clamp. The springs and locking bolt are aligned with grooves in between rails on the picatinny rail and then lock into respective holes in the universal picatinny rail mount 125, as illustratively shown by numerals 415 and 420. The springs engage with respective holes 415 and push against the locking clamp to thereby secure the locking clamp and universal picatinny rail mount to the picatinny rail of the firearm. The springs provide greater stabilization for the picatinny interface onto the picatinny rail. The locking bolt also provides support and connects the locking clamp, picatinny rail of the firearm, and the universal picatinny rail mount to securely and removably attach the picatinny interface to the firearm for use.

A head 425 of the locking bolt 405 is expanded relative to the hole on the locking clamp so the head abuts a surface area of the locking clamp 120. A shape of the head corresponds to a shape of an opening in a cam lever 315 which is positioned on top of and is can be oriented parallel or upright to the locking clamp depending on its engagement position. A safety lock 435 and a locking spring 440 secure the cam lever to the locking clamp and prevent the cam lever from unlocking. A user can push down on the safety lock which acts on the locking spring thereby allowing a user to pull the cam lever from 90° to 180°. The user can turn the cam lever clockwise to thread or counterclockwise to unthread to tighten or loosen, respectively. When desired tension is met, the cam lever is pushed down.

The cam lever moves in an engage position 305 and a disengage position 310, as illustratively shown in FIG. 3. The cam lever is in the engage position when in a down position and is oriented parallel to the locking clamp. The cam lever is in the disengage position when oriented upright to the locking clamp, such as perpendicular. In the engage position, the locking bolt and springs engage with the universal picatinny rail mount 125 to fasten the picatinny interface with the firearm's picatinny rail. In the disengage position, the locking bolt and springs disengage from the universal picatinny rail mount to remove the picatinny interface from the firearm's picatinny rail. The safety lock and locking spring can be lifted before lifting the cam lever in the disengage position, thereby preventing the cam lever from unintentionally disengaging with the firearm while, for example, in use (e.g., a user firing the firearm, running with the firearm, etc.).

The universal picatinny rail mount 125 is affixed to a pair of rods 130 on an end opposite the locking clamp 120 and cam lever 315. The rods may be comprised of steel, titanium, plastic, or other suitable material. Screws or bolts may extend through holes 165 into receiving holes on the rods (not shown) to secure the rods to the universal picatinny rail mount. While a pair of rods are illustrated in the figures, one or additional steel rods may also be utilized. The rods connect to a coupling housing 135 to which the receiving portion 140 is connected for supporting the electronic device. Ends of the steel rods extend and insert into an opening of the coupling housing and may bend at a right angle inside the coupling housing as a fastening mechanism. Other fastening mechanisms are also possible, such as screws, bolts, adhesive, and the like.

FIG. 5 shows an illustrative diagram of the picatinny interface 115 attached to the firearm 105 while simultaneously supporting an electronic device 505, which is a smartphone in this example but can be other electronic devices having a form factor which can fit within the receiving portion 140. Suitable electronic devices can be configured with a processor, memory, and a user interface to enable user interactions with the device and the device's applications.

The electronic device 505 is squeezed between the respective grips 155 in the x-grip 150. The grips may be comprised of a rubber material to provide greater friction and thereby grasp on the electronic device. The movable arms 160 to which the grips are attached can be pushed toward an x-axis of the x-grip 150. The movable arms are spring loaded, which thereby springs them back into position upon the user's release. The receiving portion from which the movable arms extend include elongated openings that enable the movable arms to move in multiple positions and thereby leverage the spring-loaded mechanism for back and forth movement of the movable arms. The electronic device can be placed inside the receiving portion and laid against the backing platform 145. Once the electronic device is inserted inside the receiving portion, the movable arms and grips can be let go by a user and thereby spring-loaded back into position to tighten and squeeze against a perimeter of the electronic device. The electronic device can therefore be supported by the backing platform and the spring-loaded x-grip.

When the firearm 105 and picatinny interface 115 are assembled, that is, the electronic device 505 is secured to the picatinny interface and the picatinny interface is attached to the firearm, a user can operate an application on the electronic device while operating the firearm. Various applications useful for operating a firearm can be utilized, such as ballistic calculators. The user can view the ballistic calculator by adjusting his eye to the electronic device while maintaining a steady position operating the firearm. For embodiments in which the picatinny interface is attached to a spotting scope, birdwatchers or nature watchers can download and utilize an application to identify different species.

Various exemplary embodiments of the present picatinny interface are now presented by way of illustration and not as an exhaustive list of all embodiments. An example includes a picatinny interface for a primary object configured with a picatinny rail, comprising: a receiving portion adapted to hold an electronic device, wherein the receiving portion includes a backing and grips that are positioned around a perimeter of the backing; a steel rod at least indirectly connected to the receiving portion; a universal picatinny rail mount connected to the steel rod, wherein the universal picatinny rail mount includes a fastening mechanism configured to detachably engage the universal picatinny interface rail mount, and thereby the picatinny interface, to the primary object; and a cam lever adapted to assume an engage position and a disengage position with the universal picatinny rail mount, wherein the engage position enables the universal picatinny rail mount to fasten to the primary object.

In another example, the fastening mechanism utilizes one or more holes inside which a locking bolt or spring engage with when the cam lever is in the engage position. As a further example, a locking clamp attached to the cam lever; and one or more springs affixed to the locking clamp, wherein the one or more springs engage with the one or more holes on the universal picatinny rail mount, and adjustment between the engage and disengage position of the cam lever respectively translates to engagement or disengagement of the one or more springs with the holes. In a further example, the locking clamp is removably attached to the primary object. In a further example, the locking bolt and the one or more springs, when the cam lever is in the engage position, extend through and between the primary object's rails while engaging with the one or more holes on the universal picatinny rail mount. In another example, a safety lock and locking spring configured to secure the cam lever to the engage position. As another example, a coupling housing to which the steel rod and the receiving portion are connected. As another example, the grips are an x-grip. In a further example, arms to which each grip in the x-grip are attached are under spring tension that causes an exertion of pressure toward a y-axis for the x-grip which enable squeezing of the electronic device by the x-grip when the electronic device is positioned inside the receiving portion. In a further example, the grips extend from respective openings on the receiving portion, and the openings are configured to enable the grips of the x-grip to move in multiple positions. In another example, the electronic device is a smartphone. In another example, the backing is a platform that provides support to the electronic device. In another example, the primary object is a firearm. In another example, the primary object is a spotting scope.

Most of the foregoing alternative examples are not mutually exclusive, but may be implemented in various combinations to achieve unique advantages. As these and other variations and combinations of the features discussed above can be utilized without departing from the subject matter defined by the claims, the foregoing description of the embodiments should be taken by way of illustration rather than by way of limitation of the subject matter defined by the claims. In addition, the provision of the examples described herein, as well as clauses phrased as "such as," "including" and the like, should not be interpreted as limiting the subject matter of the claims to the specific examples; rather, the examples are intended to illustrate only one of many possible embodiments. Further, the same reference numbers in different drawings can identify the same or similar elements.

The invention claimed is:

1. A picatinny interface for a primary object configured with a picatinny rail, comprising:

a receiving portion adapted to hold an electronic device, wherein the receiving portion includes a backing and grips that are positioned around a perimeter of the backing;

a steel rod at least indirectly connected to the receiving portion;

a coupling housing to which the steel rod and the receiving portion are connected;

a universal picatinny rail mount connected to the steel rod, wherein the universal picatinny rail mount includes a fastening mechanism configured to detachably engage the universal picatinny interface rail mount, and thereby the picatinny interface, to the primary object; and a cam lever adapted to assume an engage position and a disengage position with the universal picatinny rail mount, wherein the engage position enables the universal picatinny rail mount to fasten to the primary object.

2. The picatinny interface of claim 1, wherein the fastening mechanism utilizes one or more holes inside which a locking bolt or spring engage with when the cam lever is in the engage position.

3. The picatinny interface of claim 2, further comprising:

a locking clamp attached to the cam lever; and one or more springs affixed to the locking clamp, wherein the one or more springs engage with the one or more holes on the universal picatinny rail mount, and adjustment between the engage and disengage position of the cam lever respectively translates to engagement or disengagement of the one or more springs with the holes.

4. The picatinny interface of claim 3, wherein the locking clamp is removably attached to the primary object.

5. The picatinny interface of claim 4, wherein the locking bolt and the one or more springs, when the cam lever is in the engage position, extend through and between the primary object's rails while engaging with the one or more holes on the universal picatinny rail mount.

6. The picatinny interface of claim 5, further comprising a safety lock and locking spring configured to secure the cam lever to the engage position.

7. The picatinny interface of claim 1, wherein the grips are an x-grip.

8. The picatinny interface of claim 7, wherein arms to which each grip in the x-grip are attached are under spring tension that causes an exertion of pressure toward a y-axis for the x-grip which enable squeezing of the electronic device by the x-grip when the electronic device is positioned inside the receiving portion.

9. The picatinny interface of claim 8, wherein the grips extend from respective openings on the receiving portion, and the openings are configured to enable the grips of the x-grip to move in multiple positions.

10. The picatinny interface of claim 1, wherein the electronic device is a smartphone.

11. The picatinny interface of claim 1, wherein the backing is a platform that provides support to the electronic device.

12. The picatinny interface of claim 1, in which the primary object is a firearm.

13. The picatinny interface of claim 1, wherein the primary object is a spotting scope.

* * * * *